US009806452B2

(12) United States Patent
Zebhauser et al.

(10) Patent No.: US 9,806,452 B2
(45) Date of Patent: Oct. 31, 2017

(54) CONTACT RETAINING PART WITH SPACE FOR AXIAL MOVEMENT OF A CONTACT ELEMENT

(71) Applicant: ROSENBERGER HOCHFREQUENZTECHNIK GMBH & CO. KG, Fridolfing (DE)

(72) Inventors: Martin Zebhauser, Laufen (DE); Till Bredbeck, Traunstein (DE); Matthias Brixner, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/312,492

(22) PCT Filed: May 26, 2015

(86) PCT No.: PCT/EP2015/001077

§ 371 (c)(1),
(2) Date: Nov. 18, 2016

(87) PCT Pub. No.: WO2015/180836

PCT Pub. Date: Dec. 3, 2015

(65) Prior Publication Data

US 2017/0117656 A1 Apr. 27, 2017

(30) Foreign Application Priority Data

May 27, 2014 (DE) ..... 20 2014 004 431 U

(51) Int. Cl.
*H01R 13/514* (2006.01)
*H01R 13/422* (2006.01)
*H01R 13/436* (2006.01)

(52) U.S. Cl.
CPC ..... *H01R 13/4226* (2013.01); *H01R 13/4364* (2013.01)

(58) Field of Classification Search
CPC ..... H01R 13/514; H01R 13/627; H01R 13/4226; H01R 13/4362; H01R 13/4364; H01R 13/4365; H01R 13/6271; H01R 13/62751; H01R 13/6275
USPC ..... 439/352, 752
See application file for complete search history.

(56) References Cited

U.S. PATENT DOCUMENTS 6,645,015 B2 * 11/2003 Mase ..... H01R 13/4362 439/595
6,652,328 B2 * 11/2003 Suzuki ..... H01R 13/4365 439/595

(Continued)

FOREIGN PATENT DOCUMENTS

DE 602004011987 T2 7/2002
DE 10162589 A1 2/2009

(Continued)

OTHER PUBLICATIONS

English translation of PCT/EP2015/001077, dated May 26, 2015, 4 pages.*

*Primary Examiner* — Chandrika Prasad
(74) *Attorney, Agent, or Firm* — DeLio, Peterson & Curcio, LLC; Robert Curcio

(57) ABSTRACT

A retaining part for the pull-resistant holding of a pin-shaped contact element having a housing with an accommodation space for accommodating the contact element and at least one primary securing element which protrudes into the interior of the accommodation space and can be radially deflected, having an axial stop for a projection of the contact element in order to secure the contact element in a pull direction (Z) opposite to an insertion direction (E), wherein a secondary securing element, which in a securing position contacts at least in sections the outside of the primary securing element, is provided to prevent the radial (R) deflection of the primary securing element.

17 Claims, 1 Drawing Sheet

(56) References Cited

U.S. PATENT DOCUMENTS

| | | | | |
|---|---|---|---|---|
| 6,716,069 | B2 * | 4/2004 | Nakamura | H01R 13/4365 439/595 |
| 6,896,560 | B2 * | 5/2005 | Nakamura | H01R 13/4362 439/345 |
| 7,114,997 | B2 * | 10/2006 | Sagawa | H01R 13/4365 439/595 |
| 7,168,981 | B2 * | 1/2007 | Takahashi | H01R 13/4223 439/595 |
| 7,204,726 | B2 * | 4/2007 | Yamashita | H01R 13/4362 439/752 |
| 7,281,961 | B1 | 10/2007 | Sugiyama | |
| 7,828,581 | B2 * | 11/2010 | Okayasu | H01R 13/4362 439/352 |
| 8,011,977 | B2 * | 9/2011 | Tsuruta | H01R 13/4365 439/752 |
| 8,523,594 | B2 * | 9/2013 | Takeda | H01R 13/4223 439/352 |
| 8,894,450 | B2 * | 11/2014 | Kitajima | H01R 13/62 439/752 |
| 2002/0168896 | A1 | 11/2002 | Suzuki | |

FOREIGN PATENT DOCUMENTS

| | | | |
|---|---|---|---|
| EP | 1524730 | A1 | 4/2005 |
| EP | 2416454 | A1 | 2/2012 |
| GB | 2422255 | A | 7/2006 |

* cited by examiner

CONTACT RETAINING PART WITH SPACE FOR AXIAL MOVEMENT OF A CONTACT ELEMENT

BACKGROUND OF THE INVENTION

1. Field of the Invention

The invention relates to a retaining part for the pull-resistant holding of a pin-shaped contact element, comprising a housing with an accommodation space for accommodating the contact element and at least one primary securing element which protrudes into the interior of the accommodation space and can be radially deflected. The primary securing element has an axial stop against which a projection of the contact element can come to rest, so that the contact element accommodated in the accommodation space is secured in the retaining part in a pull direction opposite to an insertion direction. The invention also relates to a contact holder with a retaining part according to the invention and a pull-resistant contact element held thereon.

2. Description of Related Art

A pin-shaped contact element is generally understood to mean an electrical contact, elongated in form, for transmitting electrical voltage or electrical signals, for example a contact pin, an inner conductor of a cable or similar. A pull-resistant contact element held on a retaining part cannot be pulled out of the retaining part even if a tensile force is exerted in a pull direction.

Such a retaining part can be a part of a plug connector, for example an insulating part of a plug, of a male panel connector, of a socket, of a coupler, of a female panel connector or similar, whereby the contact element, for example attached to a cable end, is held in the retaining part in such a way that, even when a tensile force is exerted on the cable, the contact element can be reliably prevented from slipping out of the retaining part.

Conventional retaining parts are known with clamping sections designed to clamp a cable or a contact element of the cable thinly between the clamping sections in a force-locking manner. However, such a clamping arrangement is not sufficiently reliable where the cable is subjected to high tensile forces. Coaxial cables or other cables with an outer conductor, for example a braided conductor, can in addition be held against an outer conductor housing of the plug connector in a pull-resistant manner via the generally particularly stable outer conductor. However, it is particularly difficult to achieve a pull-resistant fixing of cables which only have one or more comparatively thin contact pins as contact elements.

In this latter case, a pull-out protection can be provided with an axial stop against which a projection of the contact element comes to rest if a tensile force acts on the contact element in the pull direction, so that the contact element is prevented from being pulled out of the retaining part in an axial direction (both the insertion direction and also the pull direction opposite to the insertion direction run substantially parallel to the axial direction of the contact element). In order to make possible a quick and user-friendly installation of the contact element in the retaining part, the pull-out protection is designed to be radially deflectable, so that during installation the projection on the contact element can be inserted past the radially deflected shoulder into the accommodation space without any problem.

However, it has been found that, despite this pull-out protection, the contact element can become detached from the retaining part under high tensile forces.

Known from EP 1 524 730 A1 is a retaining part for the pull-resistant holding of a contact element with a housing with an accommodation space for accommodating the contact element. The retaining part according to EP 1 524 730 A1 also has a primary securing element designed to secure the contact element in a pull direction opposite to an insertion direction, and the retaining part according to EP 1 524 730 A1 has a secondary securing element designed to prevent a radial deflection of the primary securing element.

Known from EP 2 416 454 A1 is also a retaining part for the pull-resistant holding of a pin-shaped contact element with a housing with an accommodation space for accommodating the contact element. The retaining part according to EP 2 416 454 A1 also has a securing element designed to secure the contact element in a pull direction opposite to an insertion direction.

Known from US 2002/0168896 A1 is a further retaining part for the pull-resistant holding of a pin-shaped contact element with a housing with an accommodation space for accommodating the contact element. The retaining part according to US 2002/0168896 A1 also has two blocking elements designed to secure the contact element in a pull direction opposite to an insertion direction.

Known from GB 2 422 255 A is a further retaining part for the pull-resistant holding of a pin-shaped contact element with a housing with an accommodation space for accommodating the contact element which has a securing element designed to secure the contact element in a pull direction opposite to an insertion direction.

SUMMARY OF THE INVENTION

In view of the problems described, it is the object of the present invention to provide a retaining part in which a contact element can be installed particularly quickly and simply and which can at the same time withstand high tensile forces acting on the contact element.

This problem is solved through a retaining part according to the independent claims. Advantageous further developments of the retaining part according to the invention are described in the dependent claims.

The above and other objects, which will be apparent to those skilled in the art, are achieved in the present invention which is directed to a retaining part for the pull-resistant holding of a pin-shaped contact element, comprising: a housing with an accommodation space for accommodating the contact element and at least one primary securing element which protrudes into the interior of the accommodation space and can be radially deflected, having an axial stop for a projection of the contact element in order to secure this in a pull direction (Z) opposite to an insertion direction (E); and a secondary securing element which in a securing position contacts, at least in sections, the outside of the primary securing element in order to prevent the radial (R) deflection of the primary securing element, wherein the housing includes the primary securing element and a second housing part includes the secondary securing element.

The primary securing element may include an outer contact surface, extending parallel to the insertion direction (E), with which an inner contact surface of the secondary securing element extending parallel to this lies in contact in the securing position.

In order to adjust a possible axial movement of the contact element), the secondary securing element may be adjusted in an axial direction from a first securing position (1) into a second securing position (II) and/or vice versa, in which positions the secondary securing element lies in radial (R) contact, at least in sections, with the outside of the primary securing element.

The secondary securing element may also include a further axial stop for a projection of the contact element in order to secure this in the insertion direction (E).

The distance (A) between the axial stop of the primary securing element and the further axial stop of the secondary securing element is preferably greater in the second securing position (II) than in the first securing position (I).

The primary securing element includes an inner surface which gradually narrows the clear width of the accommodation space in the insertion direction (E), at least in sections, which is followed, in the insertion direction (E), by the axial stop extending radially outwards in a transverse direction, in particular roughly perpendicular to the insertion direction.

The secondary securing element is part of a second housing part held, so as to be displaceable in an axial direction, on the housing, such as a cap with a side wall continuing the accommodation space in the insertion direction (E).

The primary securing element preferably includes an elastically resilient tab part which is so designed that during insertion of the contact element into the accommodation space it is pre-tensioned radially (R) outwards through the projection of the contact element and snaps into engagement behind the projection.

The primary securing element may be formed in a single piece, as a single part with the housing, integrally with this, of a plastics material.

The retaining part may include an additional securing element projecting into the interior of the accommodation space with an axial securing stop for a projection of the contact element in order to secure this in the pull direction (Z) opposite to the insertion direction (E), wherein the additional securing element is inelastic. The additional securing element is preferably arranged, in the insertion direction (E), substantially at the height of the primary securing element, the stop of the primary securing element preferably lying in roughly the same radial plane as the securing stop of the additional securing element.

In a second aspect, the present invention is directed to contact holder with a retaining part for the pull-resistant holding of a pin-shaped contact element, the retaining part comprising: a housing with an accommodation space for accommodating the contact element and at least one primary securing element which protrudes into the interior of the accommodation space and can be radially deflected, having an axial stop for a projection of the contact element in order to secure this in a pull direction (Z) opposite to an insertion direction (E); and a secondary securing element which in a securing position contacts, at least in sections, the outside of the primary securing element in order to prevent the radial (R) deflection of the primary securing element, wherein the housing includes the primary securing element and a second housing part includes the secondary securing element; wherein the pin-shaped contact element is held in a pull-resistant manner in its accommodation space.

The projection of the contact element is substantially designed as an annular flange, one side surface of which faces the axial stop of the primary securing element and/or the securing stop of the additional securing element, and/or the other side surface of which faces the further axial stop of the secondary securing element.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS(S)

Figure 1:
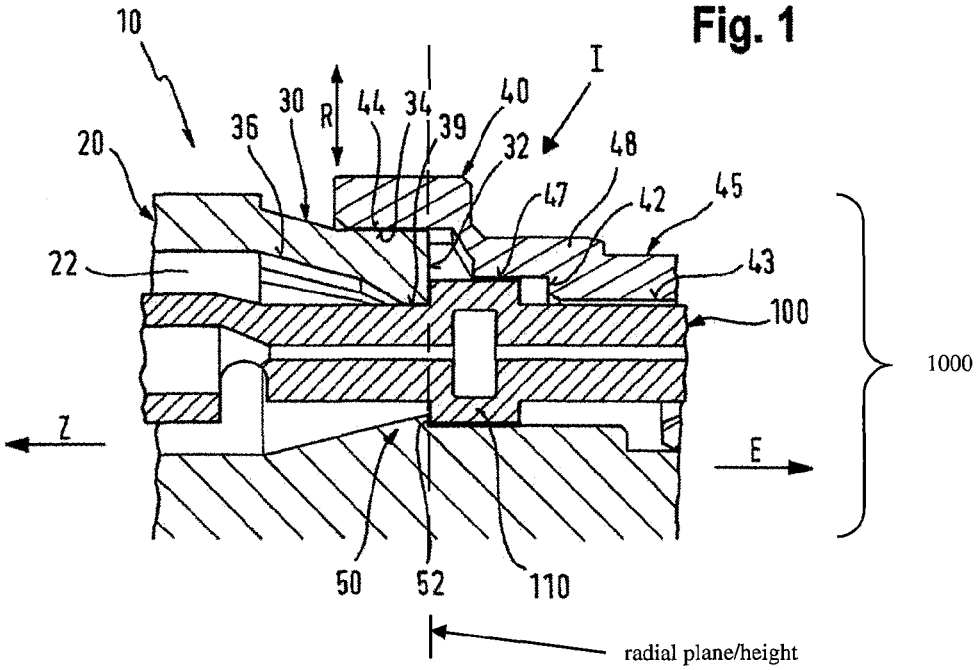
FIG. 1 shows a schematic sectional view of a retaining part according to the invention with a contact element held therein, in a first securing position 1.

In describing the preferred embodiment of the present invention, reference will be made herein to FIGS. 1-2 of the drawings in which like numerals refer to like features of the invention.

The retaining part according to the invention is characterized by a secondary securing element which, in a securing position, makes radial contact, at least in sections, with the outside of the primary securing element in order to prevent radial deflection of the primary securing element. Following insertion of the contact element into the accommodation space the secondary securing element can be fitted onto the outside of the primary securing element, whereby the secondary securing element is immovable or rigid in a radial direction, so that the primary securing element which contacts it on the inside can no longer be deflected outwards and thus can no longer release the contact element under any circumstance.

The invention is based on the knowledge that, while the radial deflectability of the primary securing element facilitates installation of the contact element in the accommodation space, on the other hand, even if the primary securing element presses against the contact element under a pre-tension, it is not impossible that the primary securing element can slide off over the projection of the contact element and thus release the contact element in the pull direction. There is for example a risk of such a "levering up" of the elastic primary securing element under the action of a particularly high or obliquely-applied tensile force. This levering up is prevented in the retaining part according to the invention through the secondary securing element securing the primary securing element.

A particularly effective securing of the primary securing element against a radial deflection of same is made possible in that the primary securing element has an outer contact surface extending parallel to the insertion direction which in the securing position lies in contact with an inner contact surface of the secondary securing element running parallel to this. The two closely contacting contact surfaces of the primary and secondary securing elements can, at least in sections, be curved in the peripheral direction and can for example be in the form of partial cylinder surfaces, or alternatively they can be designed in the form of flat (guide) surfaces oriented parallel to the insertion direction.

The secondary securing element can be displaceable in an axial direction relative to the primary securing element such that a space for a possible axial compensating movement of the contact element accommodated in the accommodation space can be adjusted through displacement of the secondary securing element. For this purpose, the secondary securing element can be adjusted in an axial direction from a first securing position into a second securing position and/or vice versa, whereby in both securing positions the secondary securing element is in each case in radial contact, at least in sections, with the outside of the primary securing element and thus prevents a radial deflection of the primary securing element. During this displacement of the secondary securing element, the inner contact surface of the secondary securing element running in an axial direction slides along the outer contact surface of the primary securing element with which it is in contact.

On the other hand, in order to make it impossible for the contact element to be pushed too far in the insertion direction into the accommodation space or to be drawn out of the retaining part on the front side, the secondary securing element preferably has a further axial stop for the projection of the contact element. In this way the contact element is secured not only in the pull direction, but also in the insertion direction opposite to this. The stops of the primary securing element and secondary securing element face one another in such a way that the projection or several projections of the contact element can be accommodated between these and, depending on the axial position of the contact element, come to rest against one or the other stop.

In order to allow the possibility of axial compensation of the contact element to be adjusted to a desired degree, it is advantageous if the distance between the axial stop of the primary securing element and the further axial stop of the secondary securing element is greater in the second securing position than in the first securing position. In the first securing position, the distance can for example substantially correspond to an axial dimension of the projection, whereby in this case no axial compensation of the contact element is possible, so that the contact element is held substantially immovably in an axial direction relative to the retaining part. In the second securing position, the distance is more than 1.5 times, preferably more than 2 times as great as the axial dimension of the projection and particularly preferably more than 1 mm, in particular more than 2 mm greater than this. In this case the contact element is held in the retaining part so as to be pull-resistant in two directions with an axial play of more than 1 mm, in particular 2 mm or more. Preferably, the retaining part according to the invention has a fixing mechanism for fixing the secondary securing element in one or more securing positions. Also, a holding mechanism can be provided which prevents the secondary securing element from being detached from the housing.

A particularly effective primary securing element is characterized through an inner surface facing the accommodation space which is oriented such that it gradually narrows the clear width of the accommodation space in the insertion direction, at least in sections. When inserting the contact element into the accommodation space, the primary securing element is gradually pressed outwards through the projection of the contact element facing the inner surface until the projection snaps into engagement behind the primary securing element. The narrowing inner surface can be followed, in the insertion direction, by the axial stop extending radially outwards in a transverse direction, in particular roughly perpendicular to the insertion direction. In a relaxed state of the primary securing element, the clear width of the accommodation space is smaller than the contact element in the region of the projection, so that the contact element can only be moved past the primary securing element after this has been displaced out of the way. Following the insertion of the contact element, the inner wall of the primary securing element can, at least in sections, lie closely against the contact element, so that both a form-locking and a force-locking connection is created between the contact element and the retaining part.

In a preferred embodiment, the secondary securing element is part of a second housing part held, so as to be displaceable in an axial direction, on the housing, such as a cap with a side wall continuing the accommodation space in the insertion direction. The cap preferably has attachment means for attaching it to the housing, whereby the attachment makes possible a guided axial movement from the first securing position into the second securing position and vice versa. A front end of the contact element can project beyond a front end of the cap. Alternatively or in addition, the cap can have a through opening for the contact element to pass through.

Preferably, the primary securing element has an elastically resilient tab part such as a leaf spring part which is so designed that during insertion of the contact element into the accommodation space it is pre-tensioned radially outwards through a projection of the contact element and snaps into engagement behind the projection.

In order to increase the stability of the retaining part, the primary securing element can be formed in a single piece, in particular integrally with the housing. Preferably, the primary securing element and the other housing sections are made of a non-conductive material, for example a plastic. In this case the housing together with the primary securing element connected thereto are formed integrally from the plastics material. The cap can also be formed integrally together with the secondary securing element connected thereto of an insulating material such as a plastics material.

According to a further, particularly important aspect, the invention relates to a retaining part for the pull-resistant holding of a contact element comprising a housing with an accommodation space for accommodating the contact element and at least one primary securing element which protrudes into the interior of the accommodation space and can be radially deflected, having an axial stop against which a projection of the contact element accommodated in the accommodation space can come to rest, so that the contact element is secured in the pull direction opposite to the insertion direction. Instead of or in addition to the secondary securing element described above, the retaining part can have an additional primary securing means in the form of an additional securing element, also projecting into the interior of the accommodation space, with an axial securing stop for the projection of the contact element. In the event of a tensile force acting on the contact element, the projection of the contact element is brought to bear against both the stop on the primary securing element as well as the securing stop on the additional securing element and is thus doubly secured in the pull direction. The additional securing element differs from the primary securing element in particular in that it is rigid and is not resilient or elastic in a radial direction.

Thus, when a tensile force acts on the contact element, otherwise than in the case of the primary securing element, there is no risk of the additional securing element snapping back radially outwards and releasing the contact element in the pull direction. At the same time, when installing the contact element in the retaining part it is possible to insert the contact element into the accommodation space in the insertion direction past the two stops projecting radially inwards, since the primary securing element yields sufficiently far in a radial direction that the projection of the contact element can slide over both stops.

For this purpose, preferably both the primary securing element and also the additional securing element have an inner surface which gradually narrows the clear width of the accommodation space in the insertion direction, at least in sections, in order to make it possible for the projection to slide over the stops as smoothly as possible during installation. Advantageously, the inner surfaces are in each case followed in the insertion direction by the stop or securing stop extending approximately radially outwards, so that the projection of the contact element can snap into engagement behind the primary securing element or behind the additional securing element.

As a further securing measure, the secondary securing element explained above can be provided, making radial contact with the outside of the primary securing element in order to prevent a radial deflection of the primary securing element in a securing position. The secondary securing element can be part of a second housing part such as a cap which is fitted to the housing following insertion of the contact element into the accommodation space. With regard to further features of the secondary securing element and the primary securing element, reference is made to the above remarks.

In terms of achieving a particularly good securing effect it has proved advantageous for the additional securing element to be arranged, in the insertion direction, substantially at the height of the primary securing element. In particular, the stop on the primary securing element can lie in roughly the same radial plane as the securing stop of the additional securing element. In this case a single, peripheral projection of the contact element such as an annular flange can be simultaneously secured on both the stop and the securing stop. Also, in this case the projection is simultaneously held both behind the axial stop of the primary securing element and also behind the securing stop by the primary securing element.

Alternatively or in addition, several elastic primary securing elements and/or inelastic additional securing elements spaced apart from one another in the insertion direction can be provided. Advantageously, one or more elastic primary securing elements lie opposite each additional securing element. In this case the contact element can have more than one projection, for example two or three projections spaced apart from one another in the insertion direction.

Alternatively or in addition, more than one elastic primary securing element and/or more than one inelastic additional securing element can be provided in the same radial plane which are for example spaced apart from one another in the peripheral direction.

It is particularly advantageous if the additional securing element lies directly opposite the primary securing element, that is to say if the additional securing element is spaced apart from the primary securing element by around 180° in the peripheral direction, since in this case the primary securing element presses the contact element particularly effectively into the recess behind the securing stop.

According to a further aspect, the invention relates to a contact holder with a retaining part according to the invention and a pin-shaped contact element held in a pull-resistant manner in its accommodation space. In the present case a "pin-shaped contact element" is understood to be an elongated contact element such as a contact pin, an inner contact or similar.

The contact element is preferably, but not necessarily, substantially rotationally symmetrical, for example roughly cylindrical in form. Starting out from a base part of the contact element one or more projections projecting radially outwards can be provided which preferably have front and/or rear side surfaces extending perpendicular to the insertion direction, so that the side surfaces can come to rest flat against the stops, which also extend perpendicular to the insertion direction. In a preferred embodiment of the invention, the projection is in the form of an annular flange which surrounds a substantially cylindrical base part of the contact element in a ring-like manner. In this way it is ensured that the securing elements of the retaining part snap into engagement behind the projection irrespective of the rotational position of the contact element. Alternatively, the contact element can have more than one projection, whereby each of the projections can be assigned a primary securing element and/or an additional securing element.

The side surface of the projection facing towards the insertion direction preferably faces the axial stop of the secondary securing element, while the side surface of the projection facing towards the pull direction preferably faces the axial stop of the primary securing element and/or the securing stop of the additional securing element.

Preferably, the retaining part has two or more accommodation spaces arranged adjacent to one another with, in each case, at least one primary securing element, secondary securing element and/or additional securing element for in each case one contact element. In this way, a two-core or multiple-core cable or a wire bundle can for example be coupled to the retaining part and connected with this in a pull-resistant manner. In a particularly preferred embodiment, the retaining part is an insulating part designed to accommodate, in a pull-resistant manner, a cable end of a (possibly unshielded) twisted-pair cable with two twisted wires to which a contact pin is in each case attached. For example, the retaining part is part of a plug connector, for example an HSD coupler.

The invention is explained in the following description with reference to the attached drawings, to which express reference is made with regard to details of importance to the invention which are not described in detail in the description.

FIG. 1 shows, in longitudinal section, a partial region of a retaining part 10 according to the invention with a contact element 100 accommodated therein. Further, FIG. 1 shows a contact holder 1000 according to embodiments, which includes retaining part 10 and contact element 100. The sectional plane thereby runs parallel to the insertion direction E, in which the contact element 100 is inserted into the retaining part 10, and parallel to the opposite pull direction Z.

The retaining part 10 has a housing 20 with an accommodation space 22 for accommodating the contact element 100 and a second housing part 45 attached to the housing 20. The second housing part 45 forms a side wall 48 continuing the accommodation space 22 in the insertion direction E.

The housing 20 is an insulating part of a plug connector such as a coupler, and the second housing part 45 forms a cap covering a front section of the coupler.

The housing 20 has a primary securing element 30 of elastic design connected thereto and the second housing part 45 has a secondary securing element 40 connected thereto to secure the primary securing element 30 against elastic deflection when in a securing position.

A contact element 100 in the form of a contact pin is held in a pull-resistant manner in the accommodation space 22 of the housing 20 which extends in the insertion direction E. In other words, the contact element 100 cannot be pulled out of the accommodation space 22, even applying a tensile force in the pull direction Z. This is due to a projection 110 which projects radially outwards from a roughly cylindrical base section of the contact element 100 coming to rest against an axial stop 32 on the primary securing element 30. A form-locking connection between the contact element 100 and the housing 20 is created through the projection 110 being brought to bear against the axial stop 32.

The axial stop 32 of the primary securing element 30 is formed by a front surface, facing in the insertion direction E, of a tab part projecting from a side wall of the housing 20 at an angle in the direction of the contact element 100. The inner surface 36 of the tab part angles gradually in the insertion direction E in the direction of the contact element 100 up to a contact region 39 in which the tab part lies in close contact with the contact element 100. Due to this gradual narrowing of the accommodation space 22 towards the contact region 39 the tab part is gradually forced outwards by the projection 110 during insertion of the contact element 100 into the accommodation space 22, until the stop 32 snaps back behind the projection 110. The inner wall 36 transitions abruptly into the stop 32 extending perpendicular to the insertion direction E, so that when a force is applied to the contact element in the pull direction Z the tab part is prevented from yielding back, at least under an only moderate tensile force.

As already indicated, in order to allow simple installation of the contact element 100 the primary securing element 30 is designed to be deflectable in a radial direction R. However, following insertion of the contact element 100, after the projection 110 has snapped behind the stop 32, it is essential that a radial deflection of the primary securing element 30 be prevented, since this would release the contact element 100 in the pull direction Z. Therefore, in the securing position shown in FIGS. 1 and 2 the secondary securing element 40 is provided on the outside of the securing position in order to secure the primary securing element 30 against a radial deflection.

The secondary securing element 40, which is formed integrally with the second housing part 45, preferably of plastic, has an inner contact surface 44 extending parallel to the insertion direction E and facing the primary securing element 30 which lies in contact with an outer contact surface 34 of the primary securing element 30 extending parallel to this. This arrangement of the two contact surfaces 34, 44 is particularly important, since it makes possible a guided displacement of the second housing part 45 relative to the housing 20 in or opposite to the insertion direction E while maintaining the securing effect of the secondary securing element 40.

In FIG. 1 a first securing position 1 is shown in which the second housing part 45 is pushed far in the direction of the housing 20. In this position a distance A between the axial stop 32 of the primary securing element 30 and a further axial stop 42 of the secondary securing element is only slightly greater than an axial dimension of the projection 110 which is arranged between the two stops 32, 42. The contact element 100 thus has only a small amount of play in an axial direction in this position.

Figure 2:
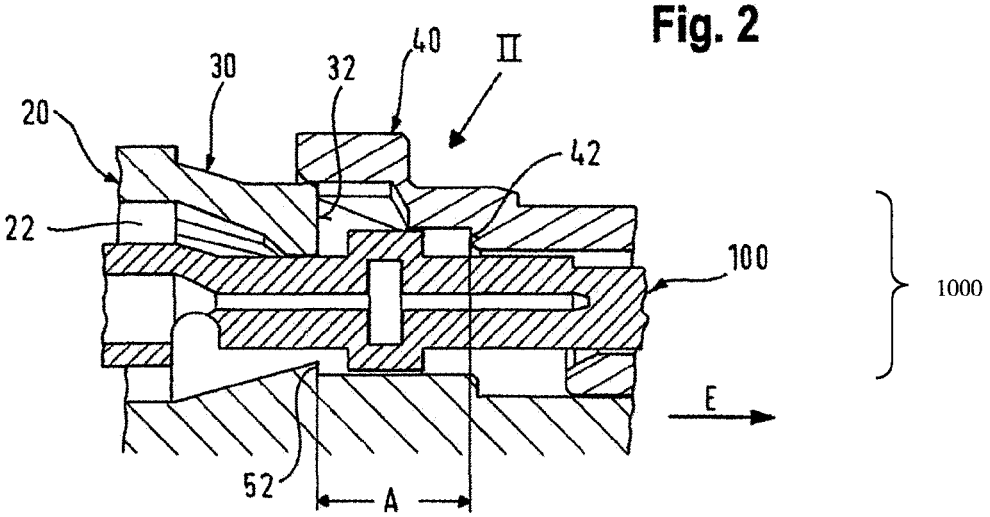
FIG. 2 shows a schematic sectional view of the retaining part shown in FIG. 1 in a second securing position II.

In the second securing position II shown in FIG. 2 the second housing part 45 is pushed forwards far in the insertion direction E relative to the housing 20. In this position a distance A between the stops 32,42 is around twice as great as the axial dimension of the projection 110 arranged between the stops 32, 42, so that the contact element has space for axial compensation movements. It is thereby important that in both securing positions 1, II the contact surfaces 34, 44 of the primary securing element and secondary securing element extending parallel to the insertion direction E lie in contact with one another, so that irrespective of the axial position of the secondary securing element no radial deflection of the primary securing element is possible.

The secondary securing element 40 shown in FIG. 1 has several sections extending outwards in steps. In the securing position, the outer contact surface 34 of the primary securing element 30 lies in contact with the inner contact surface 44 of an outer step, an outer side of the projection 110 lies in contact with the inner surface 47 of a middle step, and an outer side of a base section of the contact element 100 can lie in contact with the inner surface 43 of an inner step. This means that the diameter of the accommodation space 22 is in each case adapted to the diameter of the contact element 100, as a result of which a particularly stable guidance of the contact element 100 in an axial direction is made possible.

According to a particularly important aspect of the invention, in addition to the elastic primary securing element 30 the housing 20 has an inelastic additional securing element 50. The additional securing element 50 has an axial securing stop 52 which substantially lies in the same radial sectional plane as the stop 32 of the primary securing element 30. In particular, the additional securing element 50 lies substantially opposite to the primary securing element 30 within the accommodation space 22. The additional securing element 50 also has an inner surface which gradually narrows the clear width of the accommodation space 22 in the insertion direction E, against which the projection 110 slides during insertion and which thereby gradually forces the primary securing element 30 opposite outwards until the projection 110 snaps into engagement behind the two stops 32, 52, whereby the primary securing element 30, placed under pre-tension at this point in time, snaps back inwards. The clear width of the accommodation space 22 at its narrowest point between the primary securing element 30 and the additional securing element 50 is less than the diameter of the contact element 100 in the region of the projection 110. Behind the stops 32, 52 in the insertion direction E, the diameter of the accommodation space 22 can, in contrast, substantially correspond to the diameter of the contact element 100 in the region of the projection 110, so that in the region of the projection 110 arranged between the stops 32, 42 the contact element can be displaced in an axial direction in a stable manner, since it has no radial play.

The second housing part 45 is fixed to the housing 20 so as to be displaceable in an axial direction by means of a fixing mechanism (not shown).

A particularly reliable securing of the contact element 100 in the accommodation space 22 of the retaining part 10 against the action of tensile forces is provided if the retaining part includes both the primary and the secondary securing element and the additional securing element, because the secondary securing element 40 secures not only the primary securing element but, indirectly, also the inelastic additional securing element 50.

Alternatively, however, a retaining part 10 according to the invention is conceivable which only has the primary securing element and the secondary securing element or only the primary securing element and the additional securing element.

A method of assembling a contact holder according to the invention involves the following steps: firstly, the contact element 100 is inserted, in the insertion direction E, into the accommodation space 22 of the retaining part 10, whereby a secondary securing element 40 is not yet arranged on the primary securing element 30, so that the primary securing element 30 can be deflected radially outwards. As a result, the projection 110 slides, with deflection of the primary securing element 30, over the stops 32, 52 of the primary securing element 30 and additional securing element 50 (the tab part springs back), until the primary securing element 30 snaps into engagement behind the projection 110, so that the contact element 100 is held in a pull-resistant manner in the event of a force being applied in the pull direction Z. The second housing part 45 with the secondary securing element 40 is then connected with the housing 20, as shown in FIGS. 1 and 2, in such a way that the retaining part 10 is in its securing position. In this position, the contact element 100 is also secured by the further axial stop 42 of the second housing part 45 against a tensile force applied in the insertion direction E.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A retaining part for a pull-resistant holding of a pin-shaped contact element, comprising:

a housing with an accommodation space for accommodating a contact element and at least one primary securing element which protrudes into an interior of the accommodation space and can be radially deflected, having an axial stop for a projection of the contact element in order to secure the contact element in a pull direction (Z) opposite to an insertion direction (E); and a secondary securing element which in a securing position contacts an outside of the primary securing element in order to prevent a radial (R) deflection of the primary securing element, wherein the housing includes the primary securing element and a second housing part includes the secondary securing element, wherein a space for an axial compensating movement of the contact element accommodated in the accommodation space is adjustable.

2. The retaining part according to claim 1, wherein the primary securing element includes an outer contact surface, extending parallel to the insertion direction (E), with which an inner contact surface of the secondary securing element extending parallel to the outer contact surface lies in contact in the securing position.

3. The retaining part of claim 1, wherein the secondary securing element is adjustable in an axial direction between a first securing position (I) and a second securing position (II), wherein the contact element has a smaller amount of play in the axial direction in the first securing position (I) than in the second securing position (II).

4. The retaining part of claim 1, wherein the secondary securing element includes a further axial stop for a projection of the contact element in order to secure the contact element in the insertion direction (E).

5. The retaining part of claim 4, wherein a distance (A) between the axial stop of the primary securing element and the further axial stop of the secondary securing element is greater in the second securing position (II) than in the first securing position (I).

6. The retaining part of claim 1, wherein the primary securing element has an inner surface which gradually narrows the clear width of the accommodation space in the insertion direction (E) against which the projection slides during insertion, thereby forcing the primary securing element opposite outwards until the projection is in engagement.

7. The retaining part of claim 1, wherein the secondary securing element is part of the second housing part held on the housing, so as to be displaceable in an axial direction.

8. The retaining part of claim 1, wherein the primary securing element includes an elastically resilient tab part which is so designed that during insertion of the contact element into the accommodation space it is pre-tensioned radially (R) outwards through the projection of the contact element and snaps into engagement behind the projection.

9. The retaining part of claim 1, wherein the primary securing element is integrally formed with the housing of a plastics material.

10. The retaining part of claim 1 including an additional securing element projecting into the interior of the accommodation space with an axial securing stop for a projection of the contact element in order to secure the contact element in the pull direction (Z) opposite to the insertion direction (E), wherein the additional securing element is inelastic.

11. The retaining part of claim 10, wherein the stop of the primary securing element lies in roughly the same radial plane as the securing stop of the additional securing element.

12. The retaining part of claim 4, wherein a distance (A) between the axial stop of the primary securing element and the further axial stop of the secondary securing element is greater in the second securing position (II) than in the first securing position (I).

13. The retaining part of claim 12, wherein the primary securing element includes an elastically resilient tab part which is so designed that during insertion of the contact element into the accommodation space it is pre-tensioned radially (R) outwards through the projection of the contact element and snaps into engagement behind the projection.

14. The retaining part of claim 3, wherein the secondary securing element lies in radial (R) contact with the outside of the primary securing element in the first securing position (I) and in the second securing position (II).

15. The retaining part of claim 1, wherein the second housing part is configured as a cap with a side wall continuing the accommodation space in the insertion direction (E).

16. A contact holder with a retaining part for a pull-resistant holding of a pin-shaped contact element, said retaining part comprising:

a housing with an accommodation space for accommodating a contact element and at least one primary securing element which protrudes into an interior of the accommodation space and can be radially deflected, having an axial stop for a projection of the contact element in order to secure the contact element in a pull direction (Z) opposite to an insertion direction (E); and a secondary securing element which in a securing position contacts the outside of the primary securing element in order to prevent a radial (R) deflection of the primary securing element, wherein the housing includes the primary securing element and a second housing part includes the secondary securing element;

wherein said pin-shaped contact element is held in a pull-resistant manner in the accommodation space, and wherein a space for an axial compensating movement of the contact element is adjustable.

17. The contact holder of claim 16, wherein the projection of the contact element is substantially designed as an annular flange, one side surface of which faces an axial stop of the primary securing element and/or a securing stop of an additional securing element, and another side surface of which faces a further axial stop of the secondary securing element.

* * * * *